United States Patent [19]

Arthur

[11] Patent Number: 4,567,850

[45] Date of Patent: Feb. 4, 1986

[54] FILTER ROD MANUFACTURE

[75] Inventor: Hugh M. Arthur, High Wycombe, United Kingdom

[73] Assignee: Molins PLC, London, England

[21] Appl. No.: 536,520

[22] Filed: Sep. 28, 1983

[30] Foreign Application Priority Data

Sep. 30, 1982 [GB] United Kingdom ..... 8227993

[51] Int. Cl.[4] ..... B05B 12/08

[52] U.S. Cl. ..... 118/672; 118/692; 118/612; 118/325

[58] Field of Search ..... 118/325, 612, 688, 692, 118/672; 427/426; 239/219, 224, 304, 144, 142

[56] References Cited

U.S. PATENT DOCUMENTS 3,105,745 10/1963 Vieli ..... 427/426
3,132,808 5/1964 Ott ..... 239/142
3,226,773 1/1966 Paliyenko ..... 118/325
3,612,356 10/1971 McVey ..... 239/142
4,368,688 1/1983 Grumer et al. ..... 118/325
4,381,730 5/1983 Arthur ..... 118/325

FOREIGN PATENT DOCUMENTS 2066707 7/1981 United Kingdom .

*Primary Examiner*—Shrive P. Beck
*Attorney, Agent, or Firm*—Antonelli, Terry & Wands

[57] ABSTRACT

In the manufacture of filter rods for the tobacco industry, plasticizer and one or more flavorants or other additives are mixed in controlled proportions in a mixing chamber (100) in a tow opening machine. This allows different flavorant mixes to be made at the machine and avoids problems with mixes that separate or have short shelf lives.

4 Claims, 1 Drawing Figure

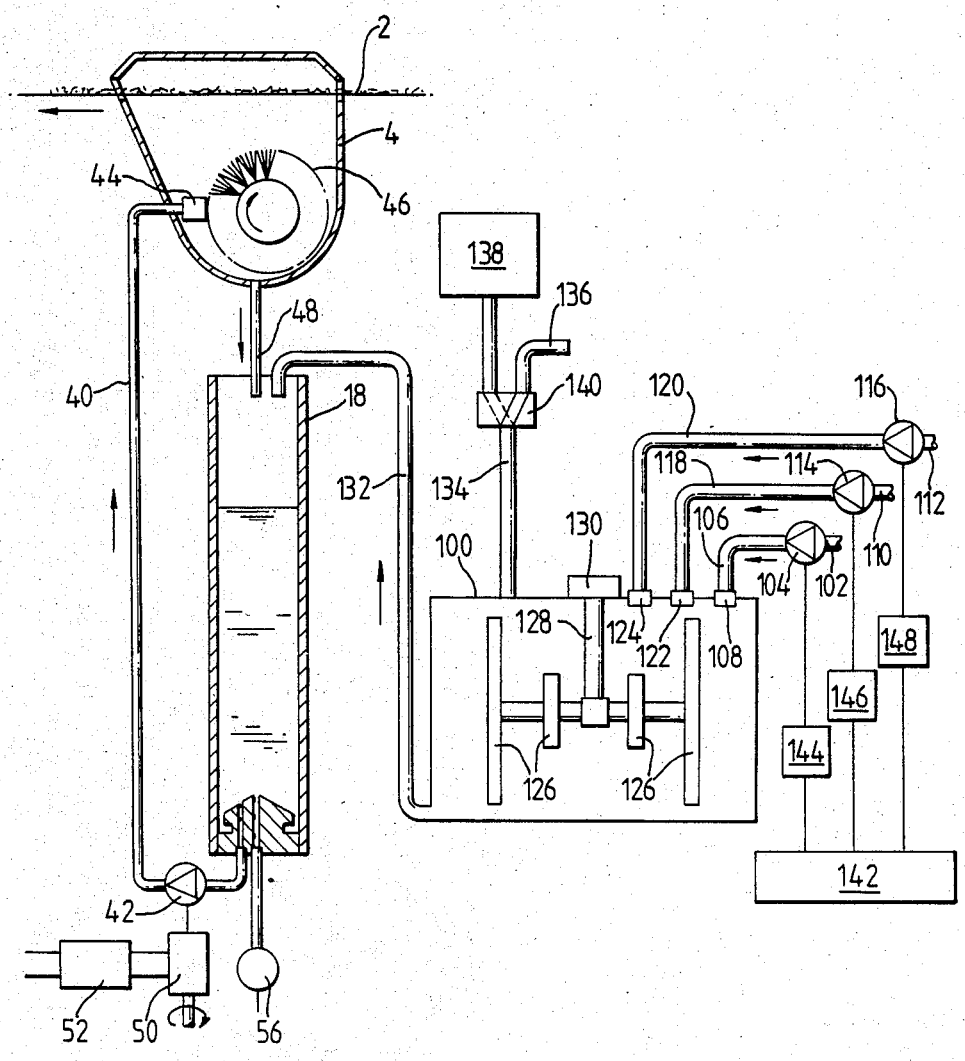
2
4
44
46
138
136
48
40
18
140
120
116
118
114
112
132
134
130
106
110
100
104
102
128
124
122
108
148
146
144
126
126
142
42
52
50
56

FILTER ROD MANUFACTURE

Filter rods, for making filter plugs for attachment to cigarette lengths, may be made by continuously forming a tow of filter material, e.g. cellulose acetate, into a rod in a rod making machine, e.g. Molins PM5N. Conventionally a so-called plasticiser (commonly triacetin) is added to the tow before it is passed into the rod making machine. When cured, the plasticiser improves the properties of the finished rod, e.g. by hardening it or providing a beneficial additional filtering effect. This invention is concerned with applying fluid additives, such as plasticiser, to filter tow.

According to one aspect the invention provides apparatus for applying fluid additive to a moving filter tow, including applicator means, means for supplying fluid additive to the applicator means, said supplying means including a fluid additive mixing zone, and means for feeding to said mixing zone controlled proportions of at least two different fluid additives. Preferably the proportions are predetermined. A plurality of flow paths leading to said mixing zone may be provided, each flow path being capable of feeding a different fluid additive, e.g. from separate sources.

The feeding means may include flow control means in separate flow paths leading from separate sources of different fluid additives. Preferably the flow control means are separately variable so that the controlled proportions may be varied. The flow control means may comprise restrictors but preferably includes fluid moving means such as a pump. Common drive means for a pump or the like in each flow path may be provided, the speed of the drive being modified (as by a gearbox) so that the pump for each path delivers fluid additive at rates in the required proportions. Alternatively each pump could be operated for different periods to pass fluid additive to the mixing zone in the required proportions. Preferably the flow rate for each pump is predictable, so that for example similar constant displacement pumps may be used and the quantities of fluid additive passed along the flow paths predicted from the applied drive speed. Alternatively, the flow paths could include flow meters and means for stopping flow when the required quantity of fluid additive had been passed. Where pumps are provided in each flow path they may be driven by independent motors under overall control of a microprocessor, the arrangement being such that each pump is driven at such speed that the required flow rate or required total flow in a given period is achieved.

The mixing zone may be arranged or adapted so that the fluid additives may be fed simultaneously and mixed by turbulence as they flow towards said applicator means. The flow from the feeding means through the mixing zone may, therefore, be continuous. Alternatively, the mixing zone may include a chamber to which said feeding means delivers fluid additives, either simultaneously or sequentially. Mechanical or other agitating or mixing means may be provided in the chamber. The supplying means may include means for periodically withdrawing mixed fluid additive from the mixing chamber. For example the supplying means may include a primary circuit including the applicator means and a reservoir, fluid additive being delivered to the primary circuit from the mixing chamber when the level of fluid additive in the reservoir falls to a predetermined value. When the mixing zone comprises a mixing chamber the feeding means may be intermittently operated, so that when pumps for separate flow paths are provided the pumps may be driven to introduce a predetermined quantity of fluid additive (in the correct proportions) into the mixing chamber.

According to another aspect of the invention a system for applying fluid additive to a moving filter tow in a machine for making continuous filter rod comprises a fluid additive supply path including applicator means for applying fluid additive to the tow, collecting means for collecting fluid additive supplied to the applicator means but not retained by the tow, recirculating means for returning the collected fluid additive to the applicator means, and means for feeding a mixture of a plurality of fluid additives to said path, said feeding means including a mixing zone, so that fluid additives are mixed in predetermined proportions in said mixing zone before passing to said path. Said feeding means may include a plurality of feed paths each leading from a different fluid additive source to said mixing zone. Preferably the mixing zone includes means adapted to cause mixing by turbulence or agitation.

The invention will be further described, by way of example only, with reference to the accompanying diagrammatic drawing, which is a part-sectional elevation of apparatus for applying fluid additive to a tow of filter material.

The apparatus includes an applicator chamber 4 in which fluid additive is sprayed onto a moving filter tow 2 by a rotary brush 46. The additive is supplied to the brush 46 by a manifold 44 which is in turn supplied with additive from a measuring cylinder 18 by way of a metering pump 42 and supply conduit 40. Fluid additive not captured by the tow 2 is collected in the chamber 4 and returned to the cylinder 18 by way of a conduit 48. A pressure transducer 56 senses the quantity of fluid additive in the cylinder 18 and is connected to an evaluating circuit (not shown) which calculates the net loss of fluid additive from the measuring cylinder 18. Signals derived from this circuit are applied to a motor 52 which adjusts the ratio of a gearbox 50 arranged between the pump 42 and a main drive source for the tow 2.

The apparatus so far described is similar to that described and illustrated in my U.S. Pat. No. 4,381,730. The disclosure of said patent is hereby incorporated herein in its entirety, and reference is directed to it for a fuller description of the operation of this part of the apparatus and in particular for details of the evaluating circuit.

The measuring cylinder 18 is periodically replenished from a mixing chamber 100. A first type of fluid additive is drawn from a first source conduit 102 by a pump 104 and supplied to the chamber 100 through a line 106 including a non-return valve 108. Second and third types of fluid additives are drawn respectively from separate second and third source conduits 110, 112 by pumps 114, 116 and supplied to the chamber 100 through conduits 118, 120, each also having non-return valves 122, 124. Mixing means, comprising paddles 126 connected to a rotatable shaft 128 driven by a small motor 130, is provided within the chamber 100. An outflow conduit 132 connects the chamber 100 to the measuring cylinder 18. A further conduit 134, connected to the upper part of the chamber 100, is selectively connectable to a vent pipe 136 or to a source of pressure air 138 by means of a valve 140.

Fluid additive introduced into the chamber 100 through each of the conduits 106, 118, and 120 is continuously mixed by rotation of the paddles 126. When a predetermined total quantity of fluid additive has been received by the chamber 100 and when the measuring cylinder 18 requires replenishment (as signalled by the evaluating circuit in response to a low pressure reading from the transducer 56, for example) the mixed fluid additive is expelled through the conduit 132 by operation of the valve 140 to connect the air pressure source 138 to the chamber 100.

The pumps 104, 114, and 116 are each of a type which allows prediction of the quantity of fluid passed (and may be identical constant displacement pumps) and are controlled so that they pass fluid additive into the mixing chamber 100 in quantities bearing a predetermined relationship. The pumps 104, 114, and 116 may therefore be driven by a common primary drive source 142 through positively infinitely variable gearboxes 144, 146, and 148. If the pumps 104, 114, and 116 have the same displacement the quantities of fluid passed are determined by the ratios of the gearboxes 144, 146, and 148.

The pumps 104, 114, and 116 could be of a type which allows variation of the displacement. In this case instead of (or possibly as well as) varying the speeds of the pumps the correct proportions of fluid additive introduced into the chamber 100 may be achieved by varying the displacement of the pumps.

Another alternative arrangement is that the pumps 104, 114, and 116 could be operated for predetermined times to allow the correct quantities of fluid additive to pass into the chamber 100. This is particularly convenient if separate motors are used for each pump. Thus the pumps 104, 114, 116 could be independently driven respectively by motors 144, 146, and 148 under control of a circuit 142 which provides timing signals. The motors 144, 146, and 148 could be stepper motors and the circuit 142 incorporated in a microprocessor.

Whether the pumps 104, 114, and 116, are controlled by varying their speed, displacement, or time of operation (or a combination of these) they may be operated simultaneously or sequentially. The valve 140 is not operated to allow pressure air from the source 138 to expel fluid additive from the chamber 100 towards the measuring cylinder 18 until the correct proportions of thoroughly mixed fluid additives are present in the chamber 100.

Typically the source conduits 102, 110, and 112 may be connected to tanks associated with the filter rod making machine complex and containing plasticisers and/or flavorants and/or other fluid additives improving or modifying the quality of the finished filter rod. The proportions in which such additives are mixed might be 90% triacetin, 6% of a first flavorant, and 4% of a second flavorant. While the example shows the mixing of three additives two or four or more additives can be mixed in suitably adapted apparatus. Any of the additives may itself be a mixture (e.g. of a plasticiser and concentrated flavorant).

The invention has the advantage of allowing accurate mixtures of fluid additives to be made just before application to the filter tow. If desired, therefore, the composition of the mixture may be varied by the machine operator. Further, the present apparatus allows application of mixtures which are either not sufficiently stable to allow use of premixed additives or which if premixed have undesirably short shelf lives. The invention is applicable to premixed additives which have a tendency to separate, so that the chamber 100 may be supplied from a single source conduit with additives already in the correct proportions.

I claim:

1. In a machine for making continuous filter rod apparatus for applying fluid additive to a moving filter tow, comprising a fluid additive supply path including applicator means for applying fluid additive to the tow, said supply path including a mixing zone and a plurality of flow paths leading to said mixing zone, means for supplying different fluid additives along said flow paths, including means for varying the proportions of additives delivered to the mixing zone, means for metering the quantity of fluid additive applied to the tow on said supply path, said supply path including a direct connection between said mixing zone and said metering means, and means for conveying mixed fluid additive from said mixing zone to said metering means, whereby different fluid additives may be mixed in controlled proportions in said mixing zone and conveyed on said supply path to said metering means for application to the two substantially immediatey after mixing.

2. Apparatus as claimed in claim 1, wherein said means for varying the proportions of additives delivered to the mixing zone includes variable flow control means in each flow path and means linking said flow control means in each flow path and means linking said flow control means for controlling the proportions of quantities of fluid additives admitted to said mixing zone.

3. Apparatus for making filter rod from filter tow, including applicator means for applying fluid additive to a moving filter tow, a reservoir for fluid additive means for supplying fluid additive from the reservoir to the applicator means, means for returning to the reservoir fluid additive supplied by said supplying means but not retained by the tow, means for measuring the rate of loss of fluid additive from the reservoir, means for determining a characteristic of the filter rod or tow, control means for varying the rate of application of fluid additive in accordance with signals derived from the measuring means and the determining means, wherein said control means includes means for varying the flow from said applicator means by varying the flow from said supplying means, said reservoir including a mixing zone and a plurality of flow paths leading to said mixing zone, means for supplying different fluid additives along said flow paths and means for varying the proportions of additives delivered to the mixing zone on said flow paths.

4. Apparatus as claimed in claim 3, wherein said means for varying the proportions of additives delivered to the mixing zone includes variable flow control means in each flow path and means linking said flow control means for controlling the proportions of quantities of fluid additives admitted to said mixing zone.

* * * * *